US007218046B2

(12) United States Patent
Bell et al.

(10) Patent No.: US 7,218,046 B2
(45) Date of Patent: May 15, 2007

(54) UNITIZED CHEMICALLY ETCHED TUNGSTEN ELECTRODE

(75) Inventors: Dean A. Bell, Marcellus, NY (US); Timothy D. Russell, North Ridgeville, OH (US)

(73) Assignee: Welch Allyn, Inc., Skaneateles Falls, NY (US)

( * ) Notice: Subject to any disclaimer, the term of this patent is extended or adjusted under 35 U.S.C. 154(b) by 0 days.

(21) Appl. No.: 11/498,346

(22) Filed: Aug. 3, 2006

(65) Prior Publication Data

US 2006/0270306 A1 Nov. 30, 2006

Related U.S. Application Data

(62) Division of application No. 10/746,991, filed on Dec. 24, 2003, now Pat. No. 7,101,245.

(51) Int. Cl.
*H01J 17/18* (2006.01)

(52) U.S. Cl. ..... 313/331; 313/631

(58) Field of Classification Search ..... 313/631, 313/331, 574, 491; 445/46, 49, 35, 52, 48
See application file for complete search history.

(56) References Cited

U.S. PATENT DOCUMENTS 3,067,357 A * 12/1962 Fridrich ..... 313/633

* cited by examiner

*Primary Examiner*—Joseph Williams
(74) *Attorney, Agent, or Firm*—Marjama & Bilinski LLP

(57) ABSTRACT

A method of making a unitized tungsten electrode which exhibits superior mechanical and electrical properties which includes providing a length of cylindrical cut stock having a predetermined diameter and length. The stock is ground to form a rough unfinished electrode having an enlarged tip or nose portion at one end integrally connected to an elongated shank section. The unfinished electrode is treated by exposure to a chemical etchant for a time sufficient to form a finished electrode characterized by a smooth nose and shank surface and rounded undercut and ends. The invention includes the electrode formed by the described process.

2 Claims, 3 Drawing Sheets

UNITIZED CHEMICALLY ETCHED TUNGSTEN ELECTRODE

FIELD OF THE INVENTION

This invention relates to an electrode design and method.

BACKGROUND OF THE INVENTION

The present invention relates in general to electrodes suitable for use in arc lamps and more specifically to a one piece or unitized electrode where the final dimensions are formed by chemical etching.

In the prior art, electrodes, i.e., anodes and cathodes which are used in lamps, such as arc lamps, are generally mechanically formed. In some cases the electrodes are mechanically ground to the required tolerances and dimensions, which is labor intensive and costly. Furthermore, these mechanical forming methods result in undesirable stresses created by the electrode geometry resulting from the manufacturing process and contribute to a short lamp life. Electrodes formed in this manner are also subject when sealed in a glass envelope to cracking and/or stresses to the glass at the distal end of the anode or cathode due to a relative large geometry and sharp edges which are inherent in the forming process.

In another prior art technique, the electrode nose or head portion can be welded onto the shank portion to avoid some of the grinding requirements described above. This manufacturing technique is characterized and is the cause of embrittlement of the electrode shank when welded to form a two piece electrode, thus introducing another failure mode. The electrodes of the type described above are characterized in that they often produce streamers in the arc coming off multiple points on the edge of the electrode tip due to the manufacturing technique and geometry irregularities resulting from these methods.

It therefore can be seen that there is a need in the field for an electrode which eliminates the sharp geometry at the distal end of the electrode shank and uneven performance of the tip portion to provide and improve overall lamp life.

SUMMARY OF THE INVENTION

It is therefore an objective of the present invention to provide for a unitized electrode which overcomes the problems of the prior art described above.

It is a further object of the present invention to provide an electrode which results in improved lamp life because of improved electrode geometry.

It is a further object of the present invention to provide an electrode which eliminates sharp geometry at the distal end of the electrode.

It is a further object of the present invention to provide an electrode which exhibits reduced stress when sealed in a glass envelope.

It is a further object of the present invention to provide an improved electrode having a rounded head which improves the focus of the arc on the center of the electrode.

It is yet another object of the present invention to provide unitized tungsten electrode which when sealed in a glass envelope eliminates embrittlement and misalignment.

The present invention is directed to a method of making an unitized tungsten electrode which exhibits superior mechanical and electrical properties and the electrode produced by such method. The method includes providing a length of cylindrical cut stock having a predetermined diameter and length. The stock is ground to form a rough unfinished electrode having an enlarged tip or nose portion at one end integrally connected to an elongated shank section. The unfinished electrode is formed into a finished electrode to the desired dimensions by exposing the electrode to a chemical etchant for a time sufficient to form a finished electrode characterized by a smooth nose and shank surface, and rounded shoulders. In one embodiment, the chemical treatment is carried out by immersion of the unfinished electrode in a bath containing sodium hypochlorite at an elevated temperature.

The finished product consists of an unitized tungsten electrode having a smooth rounded tip or nose portion and a shank portion having a rounded distal end. The electrode further is characterized by rounded shoulders and a chemically etched smooth surface. The unique geometry of the electrode functions to reduce stress when sealed in a glass envelope, and contributes to eliminating embrittlement and misalignment, with the rounded tip functioning to focus the arc to the center of the electrode resulting in greater efficiency and longer lamp life.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1C:
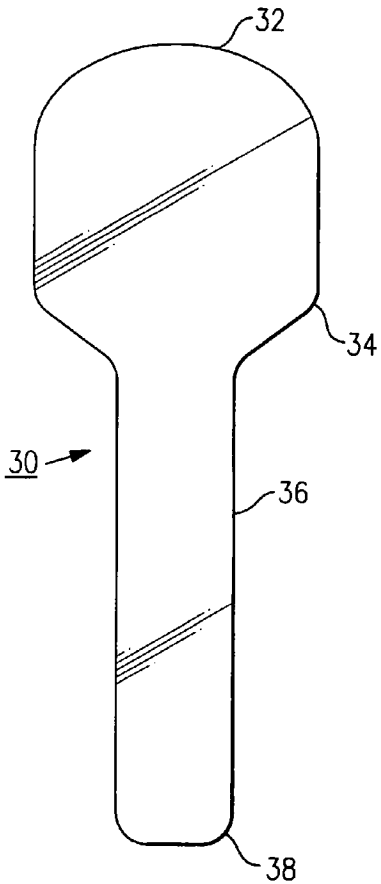
FIGS. 1*a, b* and *c* illustrate the basic steps in forming the electrode in the present invention.
Figure 1B:
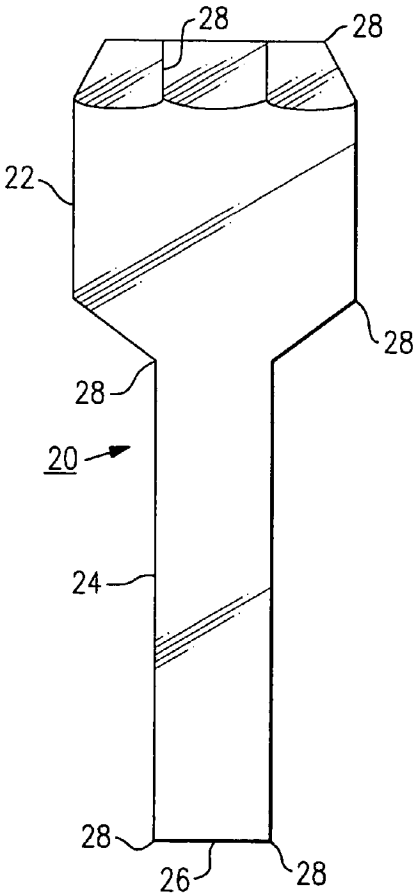
Figure 1A:
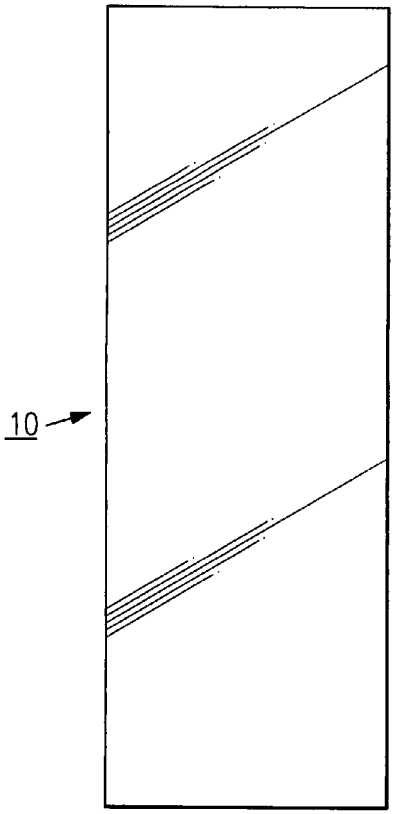

The manufacture of the electrode of the present invention is illustrated in FIGS. 1*a–c* of the present invention in which a cylindrical piece of stock 10 (FIG. 1*a*) is mechanically ground by conventional means into a rough unfinished electrode 20 (FIG. 1*b*) having an enlarged tip or nose portion 22 and an elongated shank 24 having a distal end 26 with sharp edges 28 at both the distal end and nose portion.

The unfinished electrode 20 is then immersed in a bath containing sodium hypochlorite maintained at a temperature in the range of about 180–212° F. for about three to fifteen minutes. Typically the electrode is chemically etched in a bath in batch 10 to 50 electrodes at a time. The unfinished electrodes typically are made from tungsten stock 0.016 to 0.040 inches in diameter, 0.250 to 0.500 inches in length. The unfinished electrodes are then immersed in a suitable 500 ml heated bath (180–212° F.) of 6% sodium hypochlorite in water. The sodium hypochlorite functions to preferably attack the sharp edges of the electrode and results in the formation of electrode 30 (FIG. 1*c*) having a rounded tip or nose portion 32, smooth undercut 34, smooth elongated shank 36 having a rounded distal end 38. The electrode is further characterized by a chemically etched smooth surface. Furthermore, the sodium hypochlorite functions to eliminate rough grind marks on the surface of the electrodes.

Figure 2A:
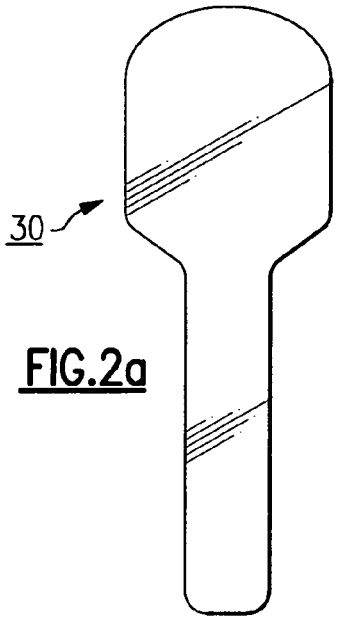
FIGS. 2*a* and *b* illustrate the finished electrode and its relative proportions and a typically winding when the electrode is used as an anode.
Figure 2B:
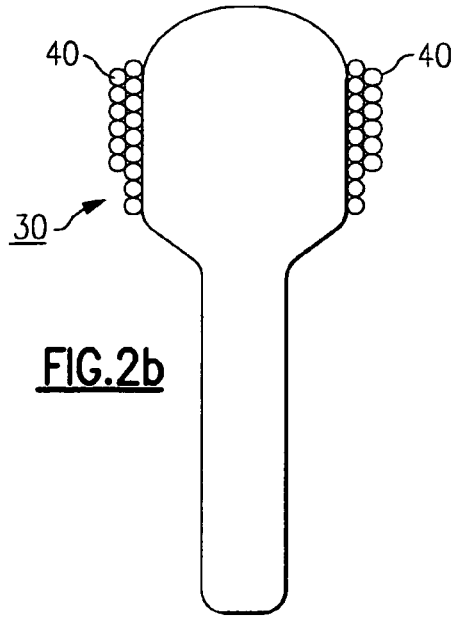

FIG. 2*a* illustrates the relative proportions and dimensions of the finished electrode 30, with a metallic wire tungsten winding 40 shown in FIG. 2*b*.

Figure 3:
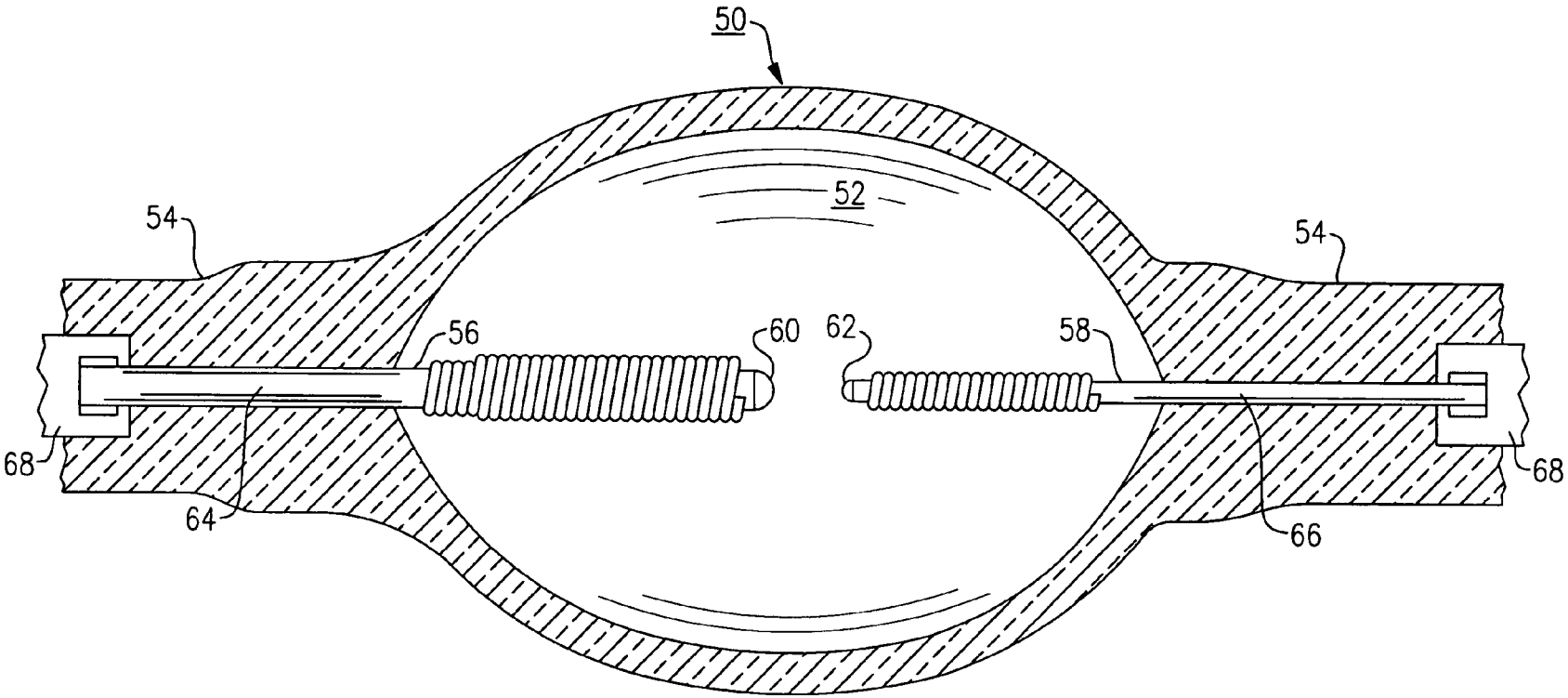
FIG. 3 illustrates a side sectional view of a conventional arc lamp utilizing the electrode of the present invention.

FIG. 3 of the drawings illustrates a glass envelope 50 of the present invention which is made of a quartz glass having a chamber 52, neck portions 54 and a pair of electrodes 56 (anode) and 58 (cathode) having tip portions 60 and 62 and shank portions 64 and 66, respectively. Typically the end of each shank is connected to a metal foil 68, usually made of molybdenum.

Figure 4:
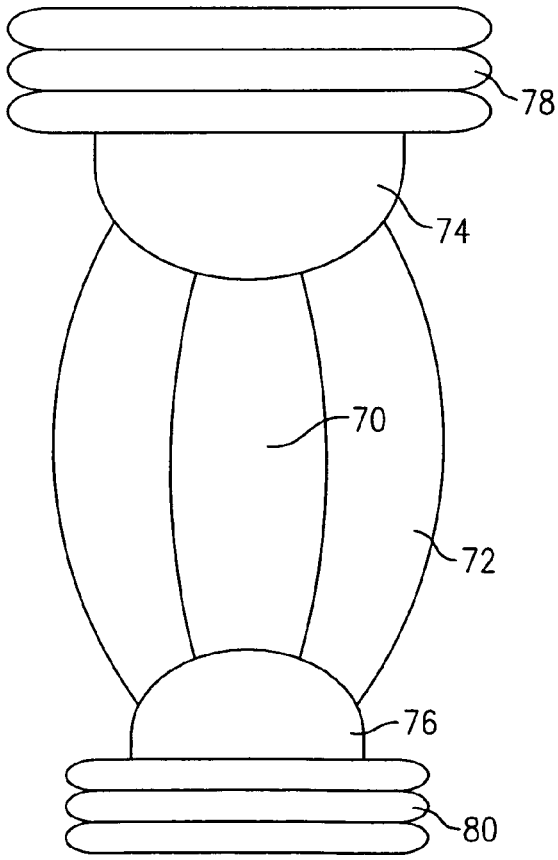
FIG. 4 is a perspective view of the anode and cathode illustrating the arc formed by the anode when used in a lamp.

In operation the anode of the present invention is used in combination with the cathode as illustrated broadly in FIG. 3. FIG. 4 illustrates the hot arc center 70 of arc 72 in a stable condition between the electrodes, anode 74 and cathode 76, of the present invention. In this embodiment, the anode and cathode have tungsten wire windings 78 and 80, respectively. The stability is determined by observing a projected image of the arc. Because of the geometry of the anode formed by the present invention, the arc center does not translate or dance across the electrode surface but is confined to the arc center as illustrated in FIG. 4.

In another embodiment of the present invention the electrode may be in the form of a straight shank in which the ends of the stock are rough ground and the surface and ends of the electrode are treated and finished in the chemical etchant as described above.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A unitized tungsten electrode which exhibits superior mechanical and electrical properties which comprises a smooth rounded tip or nose portion and a shank portion having a rounded distal end, rounded shoulders, and a chemically etched smooth surface over the entire electrode.

2. A lamp which includes a glass envelope having an internal chamber which includes a pair of electrodes at least one of which is a unitized tungsten electrode having a smooth rounded tip or nose portion and a shank portion having a rounded distal end, rounded shoulders, and a chemically etched smooth surface over the entire electrode, whereby said electrode geometry functions to reduce stress in sealing in a lamp, eliminates embrittlement and misalignment, with said rounded tip functioning to focus an arc generated by said lamp to the center of the electrode.

* * * * *